US006878676B1

(12) United States Patent
Migdal et al.

(10) Patent No.: US 6,878,676 B1
(45) Date of Patent: Apr. 12, 2005

(54) NANOSIZED PARTICLES OF MOLYBDENUM SULFIDE AND DERIVATIVES, METHOD FOR ITS PREPARATION AND USES THEREOF AS LUBRICANT ADDITIVE

(75) Inventors: Cyril A. Migdal, Pleasant Valley, NY (US); Paul E. Stott, Southbury, CT (US); Victor N. Bakunin, Moscow (RU); Oleg P. Parenago, Moscow (RU); Galina N. Kuz'mina, Moscow (RU); Ludmila M. Vedeneeva, Moscow (RU); Andrei Yu Suslov, Moscow (RU)

(73) Assignee: Crompton Corporation, Middlebury, CT (US)

( * ) Notice: Subject to any disclaimer, the term of this patent is extended or adjusted under 35 U.S.C. 154(b) by 38 days.

(21) Appl. No.: 10/275,139

(22) PCT Filed: May 8, 2001

(86) PCT No.: PCT/US01/14982

§ 371 (c)(1),
(2), (4) Date: Mar. 18, 2003

(87) PCT Pub. No.: WO01/94504

PCT Pub. Date: Dec. 13, 2001

(51) Int. Cl.[7] ..... C10M 159/18; C10M 171/06

(52) U.S. Cl. ..... 508/230; 508/362; 508/363; 508/381

(58) Field of Search ..... 508/230, 381

(56) References Cited

U.S. PATENT DOCUMENTS 3,275,554 A 9/1966 Wagenaar ..... 252/50
3,419,589 A 12/1968 Larson et al. ..... 260/429
3,438,757 A 4/1969 Honnen et al. ..... 44/58
3,445,441 A 5/1969 Rushton ..... 260/89.5
3,454,555 A 7/1969 Voort et al. ..... 260/239
3,509,051 A 4/1970 Farmer et al. ..... 252/33.6
3,565,804 A 2/1971 Honnen et al. ..... 252/50
3,674,824 A 7/1972 Amidon et al. ..... 260/429

(Continued)

OTHER PUBLICATIONS

Boakye et al., J. Coll. Interface Sci. 163 (1):120–129(1994).
Deng et al., Chem. Lett (6):483–484(1997).
Huang et al., Lang Muir 13(2): 172–175(1997).
Meldrum et al., J. Chem. Soc. Faraday Trans. 91(4):673–680(1995).
Motte et al., J. Phys II: 7(3):517–527(1997).
Motte et al., J. Phys. Chem. 99(44):16425–16429(1995).
Pileni et al., Surf. Rev. Leters 3(1):1215–1218(1996).
Steigerwald et al., J. Amer. Chem. Soc. 110(10):3046–3050(1988).
Yanagida et al., Bull. Chem. Soc. Jpn. 68(3):752–758(1995).
Zaimovskaya T.A. et al. Izu. An SSR. Ser. Khim., No. 5:2151(1991).

*Primary Examiner*—Ellen M McAvoy
(74) *Attorney, Agent, or Firm*—Michael P. Dilworth

(57) ABSTRACT

A lubricant composition is disclosed that comprises: (a) a lubricant and (b) at least one molybdenum-containing compound in the form of surface-capped nanosized particles of the general formula: $(Z)_n(X—R)_m$ wherein Z is an inorganic moiety comprising molybdenum and sulfur in the form of particles having dimensions in the range of from about 1 to about 100 nm; (X—R) is a surface-capping reagent wherein R is a $C_4$ to $C_{20}$ straight or branched-chain alkyl or alkylated cycloalkyl radical or radicals and X is a functional group capable of specific sorption and/or chemical interaction with molybdenum/sulfur moiety; n is the number of molecules of Z in the particles; m is an integer representing the amount of surface-capping reagents relative to a single particle; and the ratio of m to n is in the range of from about 1:1 to about 10:1.

27 Claims, 1 Drawing Sheet

U.S. PATENT DOCUMENTS

| | | | | |
|---|---|---|---|---|
| 3,678,135 | A | | 7/1972 | Mastromatteo et al. ..... 260/889 |
| 3,755,433 | A | | 8/1973 | Miller et al. ..... 252/51.5 |
| 3,822,209 | A | | 7/1974 | Knapp et al. ..... 252/47 |
| 4,098,705 | A | | 7/1978 | Sakurai et al. ..... 252/33.6 |
| 4,164,473 | A | | 8/1979 | Coupland et al. ..... 252/32.7 |
| 4,259,194 | A | | 3/1981 | deVries et al. ..... 252/46.4 |
| 4,259,195 | A | | 3/1981 | King et al. ..... 252/49.7 |
| 4,265,773 | A | | 5/1981 | deVries et al. ..... 252/46.4 |
| 4,266,945 | A | | 5/1981 | Karn ..... 44/68 |
| 4,272,387 | A | | 6/1981 | King et al. ..... 252/46.4 |
| 4,283,295 | A | | 8/1981 | deVries et al. ..... 252/46.4 |
| 4,285,822 | A | | 8/1981 | deVries et al. ..... 252/46.4 |
| 4,289,635 | A | | 9/1981 | Schroeck ..... 252/32.7 |
| 4,315,826 | A | | 2/1982 | Schlicht et al. ..... 252/46.4 |
| 4,369,119 | A | | 1/1983 | deVries et al. ..... 252/42.7 |
| 4,395,343 | A | | 7/1983 | deVries et al. ..... 252/32.7 |
| 4,402,840 | A | | 9/1983 | deVries et al. ..... 252/45 |
| 4,474,673 | A | | 10/1984 | Hunt et al. ..... 252/42.7 |
| 4,479,883 | A | | 10/1984 | Shaub et al. ..... 252/32.7 |
| 4,501,678 | A | | 2/1985 | Katayama et al. ..... 252/32.7 |
| 4,765,918 | A | | 8/1988 | Love et al. ..... 252/46.4 |
| 4,889,647 | A | | 12/1989 | Rowan et al. ..... 252/42.7 |
| 4,995,996 | A | | 2/1991 | Coyle et al. ..... 252/42.7 |
| 5,017,299 | A | | 5/1991 | Gutierrez et al. ..... 252/51.5 |
| 5,084,197 | A | | 1/1992 | Galic et al. ..... 252/52 |
| 5,102,566 | A | | 4/1992 | Fetterman, Jr. et al. .... 252/32.7 |
| 5,498,809 | A | | 3/1996 | Emert et al. ..... 585/13 |
| 5,770,172 | A | * | 6/1998 | Linehan et al. ..... 423/561.1 |
| 6,413,489 | B1 | * | 7/2002 | Ying et al. ..... 423/600 |
| 6,562,765 | B1 | * | 5/2003 | Boffa ..... 508/221 |

* cited by examiner

NANOSIZED PARTICLES OF MOLYBDENUM SULFIDE AND DERIVATIVES, METHOD FOR ITS PREPARATION AND USES THEREOF AS LUBRICANT ADDITIVE

BACKGROUND OF THE INVENTION

1. Field of the Invention

This invention relates to organo molybdenum derivatives and their use as multifunctional friction modifier, antiwear, extreme pressure, antioxidant additives for lubricants.

2. Description of Related Art

Regulatory agencies today are seeking to improve the fuel economy of cars on the road through legislation (CAFE requirements) putting this responsibility on the car manufacturers who, in turn, transfer some of this responsibility to the lubricant oil manufacturers via engine oil specifications. It can be seen that as these fuel economy requirements become more stringent, friction modifier additives become more important to incorporate into lubricant compositions. It is an object of this invention to provide a friction modifier additive that imparts a reduction in the coefficient of friction to a lubricant composition.

In addition, zinc dialkyldithiophosphates (ZDDP) have been used in formulated oils as anti-wear and antioxidant additives for more than 50 years. However, zinc dialkyldithiophosphates give rise to ash, which contributes to particulate matter in automotive exhaust emissions. Regulatory agencies are seeking to reduce emissions of zinc into the environment. In addition, the phosphorus is also suspected of limiting the service life of catalytic converters, used on cars to reduce pollution. It is important to limit the particulate matter and pollution formed during engine use for toxicological and environmental reasons, but it is also important to maintain, undiminished, the anti-wear and antioxidant properties of the lubricating oil. In view of the aforementioned shortcomings of the known zinc and phosphorus-containing additives, it is a further object of this invention to provide anti-wear and antioxidant additives that contain neither zinc nor phosphorus.

In developing lubricating oils, there have been many attempts to provide additives that impart anti-frictional or oiliness properties to lubricating oils and molybdenum compounds are known to be useful as friction modifiers, antiwear, extreme pressure, and antioxidants in lubrication oil compositions.

Thiocarbamate additives for lubricating oils, particularly molybdenum-containing thiocarbamates have been disclosed in the patent literature. For example, U.S. Pat. Nos. 4,395,343; 4,402,840; 4,285,822; 4,265,773; 4,272,387; 4,369,119; 4,259,195; 4,259,194; and 4,283,295, all to DeVries and King, disclose a variety of molybdenum, sulfur, and nitrogen containing compounds, including dithiocarbamates, that are useful as antioxidants for lubricants.

U.S. Pat. No. 3,509,051 discloses various molybdenum dialkyldithiocarbamates, derived from secondary amines, which are said to be useful as antioxidant and antiwear compounds for lubricating oils.

Complexes of molybdenum oxides and nitrogen-containing moieties, including dialkyldithiocarbamates, which are said to have utility as additives for lubricants, are disclosed in U.S. Pat. No. 3,419,589 to Larson et al and U.S. Pat. No. 4,164,473 to Coupland et al.

U.S. Pat. No. 3,541,014 to LeSuer discloses molybdenum complexes of Group II metal-containing compounds, e.g., overbased Group II metal sulfonates that are said to improve extreme pressure properties and antiwear properties in lubricant compositions.

A molybdenum dihydrocarbyldithiocarbamate compound said to be useful as an additive for lubricants is disclosed in U.S. Pat. No. 4,098,705 to Sakurai et al.

U.S. Pat. No. 4,266,945 discloses the preparation of molybdenum-containing compositions by the reaction of an acid of molybdenum or salt thereof, phenol or aldehyde condensation product therewith, and a primary or secondary amine. The preferred amines are diamines such as tallow-substituted trimethylene diamine and their formaldehyde condensation products. An optional but preferred ingredient in the reaction mixture is at least one oil-soluble dispersant. The molybdenum-containing compositions are said to be useful as additives in lubricants and fuels, especially in lubricants when combined with compounds containing active sulfur.

Sulfur and phosphorus-containing molybdenum compositions said to be useful for improving fuel economy for internal combustion engines are disclosed in U.S. Pat. No. 4,289,635 to Schroeck.

U.S. Pat. No. 4,315,826 discloses multipurpose lubricant additives that are prepared by reaction of carbon disulfide with thiomolybdenum derivatives of polyalkenylsuccinimides having basic nitrogen functions. The subject additives function as dispersants and are said to possess excellent anti-frictional properties and to impart anti-wear and antioxidant properties to a lubricant.

U.S. Pat. No. 4,474,673 discloses the preparation of anti-friction additives for lubricating oil by reacting a sulfurized organic compound having an active hydrogen or potentially active hydrogen with a molybdenum halide.

U.S. Pat. No. 4,479,883 discloses a lubricating oil composition that contains a relatively low level of phosphorus and is said to have particularly improved friction reducing properties that comprises an ester of a polycarboxylic acid with a glycol or glycerol and a selected metal dithiocarbamate.

U.S. Pat. No. 4,501,678 discloses a lubricant containing molybdenum dialkyldithiocarbamates said to be useful for improving fatigue life of gears.

U.S. Pat. No. 4,765,918 discloses the preparation of a lubricating oil additive by reacting a triglyceride with a basic nitrogen compound to form a reaction product, reacting said reaction product with an acidic molybdenum compound to form an intermediate reaction product, and reacting said intermediate reaction product with a sulfur compound to produce a lubricating oil additive.

U.S. Pat. No. 4,889,647 discloses molybdenum complexes prepared by reacting (a) a fatty oil, (b) diethanolamine, and (c) a molybdenum source. The molybdenum complexes are said to impart antifriction and antiwear properties to lubricating compositions and to decrease fuel consumption in internal combustion engines using them.

U.S. Pat. No. 4,995,996 discloses a lubricating composition comprising a major amount of an oil of lubricating viscosity and a minor amount of an additive having the formula $Mo_2L_4$ wherein L is a ligand selected from xanthates and mixtures thereof and, in particular, xanthates having a sufficient number of carbon atoms to render the additive soluble in the oil. In general, the xanthate ligand, L, will have from about 2 to 30 carbon atoms.

U.S. Pat. No. 5,498,809 discloses oil soluble copolymers derived from ethylene and 1-butene that have a number average molecular weight between about 1,500 and 7,500, at least about 30 percent of all polymer chains terminated with ethylvinylidene groups, and ethylene-derived content of not greater than about 50 weight percent, and which form solutions in mineral oil free of polymer aggregates, as determined by light scattering measurements. Lubricating oil additives, particularly dispersants, produced by the functionalization and derivatization of these copolymers are said to have enhanced performance (e.g., improved dispersancy and pour point) in lubricating oil compositions, attributable in part to the combination of properties characterizing the copolymers.

The preparation of nanosized surface-capped inorganic sulfides via intermediate reverse microemulsion formation is described in the following references:

Boakye et al. *J. Coll. Interface Sci.* 163(1):120–129 (1994) describe the synthesis of molybdenum sulfide nanosized particles in the range of 10–80 nm without surface-capping reagents.

Deng et al., *Chem. Lett.*(6):483–484 (1997) describe a novel synthetic approach to CdS nanoparticles capped with an electric neutral surface capping agent of 2,2-bipyridine in sodium(bis-2-ethylhexyl) sulfosuccinate (AOT) reverse micelle.

Huang et al., *Langmuir* 13(2):172–175 (1997) describe copper nanoparticles capped with poly-(N-vinylpyrrolidone) and prepared by the reduction of Copper II acetate in water and 2-ethoxyethanol using hydrazine under reflux.

Meldrum et al. *J. Chem. Soc. Faraday Trans.* 91 (4):673–680 (1995) describe the formation of thin particulate films from silver nanoparticles, generated by the sodium borohydride reduction of aqueous silver nitrate within sodium(bis-2-ethylhexyl) sulfosuccinate reverse micelles in 2,2,4-trimethylpentane and capped with octadecanethiol.

Motte et al., *J. Phys III* 7(3):517–527 (1997) describe reverse micelles that have been used to synthesize 5.6 nm silver sulfide particles. These nanoparticles are coated with dodecanethiol, extracted from reverse micelles, and then dissolved in heptane.

Motte et al., *J. Phys. Chem.,* 99(44):16425–16429 (1995) describe utilization of dodecanethiol for surface capping of various metal sulfide nanosized particles.

Pileni et al. *Surf. Rev. Letters* 3(1):1215–1218 (1996) describe synthesis of silver sulfide semiconductor clusters encapped with dodecanethiol.

Steigerwald et al. *J. Amer. Chem. Soc.* 110(10): 3046–3050 (1988) describe a synthesis of nanometer-sized clusters of CdSe using organometallic reagents in inverse micellar solution and chemical modification of the surface of these cluster compounds to form a PhSe layer on the CdSe surface.

Yanagida et al. *Bull. Chem. Soc. Jpn.* 68(3):752–758 (1995) describe size-controlling CdS nanocrystallites that were prepared by using thiophenol or hexanethiol as a capping reagent by controlling the ratio of $Cd^{++}$ to bis (trimethylsilyl) sulfide as a source of the sulfide ion in reversed micelles.

Unfortunately, a problem remains in that many molybdenum compounds exhibit poor solubility in lubricant oils. No disclosures are known to the present inventors that teach or even suggest nanosize particles comprising a molybdenum/sulfur moiety whose surface is modified with an appropriate ligand that prevents the coagulation of the nanoparticles and provides their solubility and stability in hydrocarbons or similar solvents, which further improves anti-wear properties, antioxidant properties, extreme pressure properties, and friction modifying properties in lubricating oil compositions.

SUMMARY OF THE INVENTION

The additives of the present invention are complex reaction products prepared in a series of reactions. The additives are molybdenum sulfide nanosized particles [$MoS_x$] whose surfaces are modified with one or more appropriate ligands to prevent the coagulation of the nanoparticles and provide solubility and stability therefor in hydrocarbons or similar solvents.

More specifically, the present invention is directed to a lubricant composition comprising:

A) a lubricant, and

B) at least one molybdenum-containing compound in the form of surface-capped nanosized particles of the general formula $$(Z)_n(X—R)_m$$

wherein:

Z is an inorganic moiety comprising molybdenum and sulfur in the form of particles having dimensions in the range of from about 1 to about 100 nm;

(X—R) is a surface-capping reagent where R is a $C_4$ to $C_{20}$ straight or branched-chain alkyl or alkylated cycloalkyl radical or radicals and X is a functional group capable of specific sorption and/or chemical interaction with the molybdenum/sulfur moiety;

n is the number of molecules of Z in the particles;

m is an integer representing the amount of surface-capping reagents relative to a single particle; and the ratio of m to n is in the range of from about 1:1 to about 10:1.

In another aspect, the present invention is directed to a process for preparing a molybdenum-containing compound in the form of surface-capped nanosized particles of the general formula $$(Z)_n(X—R)_m$$

wherein:

Z is an inorganic moiety comprising molybdenum and sulfur in the form of particles having dimensions in the range of from about 1 to about 100 nm;

(X—R) is a surface-capping reagent wherein R is a $C_4$ to $C_{20}$ straight or branched-chain alkyl or alkylated cycloalkyl radical or radicals and X is a functional group capable of specific sorption and/or chemical interaction with the molybdenum/sulfur moiety;

n is the number of molecules of Z in the particles;

m is an integer representing the amount of surface-capping reagents relative to a single particle; and the ratio of m to n is in the range of from about 1:1 to about 10:1; wherein the process comprises the steps of:

A) creating a reversed microemulsion comprising a hydrocarbon-soluble surfactant solution in an organic solvent or solvent mixture and an aqueous solution of a water-soluble inorganic molybdenum (VI) compound;

B) is necessary to create a molybdenum/sulfur moiety, converting the water-soluble inorganic molybdenum (VI) compound into a thio-derivative by reaction with hydrogen sulfide;

C) adding a surfactant that chemically interacts with and/or adsorbs on the molybdenum/sulfur moiety;

D) removing water and the organic solvent(s) from the microemulsion and extracting the molybdenum/sulfur moiety-containing products thereof in the form of surface-capped nanosized particles with a suitable organic solvent; and E) removing said suitable organic solvent.

The present invention is also directed to the use of the surface-capped nanosize molybdenum sulfide derivative particles as friction modifying, antiwear, extreme pressure, and antioxidant additives for lubricating oils.

The present invention is also directed to lubricating oil compositions comprising a lubricating oil and a functional-property-improving amount of the surface-capped nanosize molybdenum/sulfur moiety-containing particles described above.

Preferably, the present invention is directed to a composition comprising:

A) a lubricant;

B) surface-capped nanosize molybdenum/sulfur moiety-containing particles; and, optionally, C) one or more auxiliary additives selected from the group consisting of dispersants, detergents, rust inhibitors, antioxidants, metal deactivators, anti-wear agents, antifoamants, friction modifiers, seal swell agents, demulsifiers, VI improvers, and pour point depressants.

DESCRIPTION OF THE PREFERRED EMBODIMENT(S)

Figure 1:
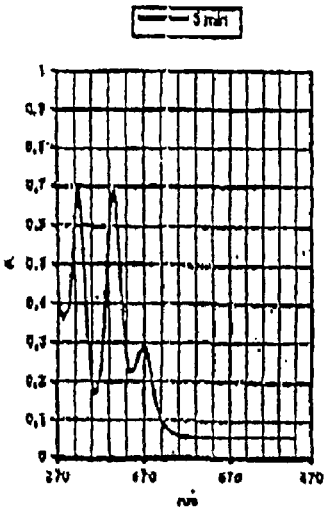
FIGS. 1 through 3 are UV spectra that are illustrative of the formation of partially substituted thiomolybdate derivatives.

The present invention provides a lubricant composition, e.g., a lubricating oil composition, comprising an organo molybdenum additive that imparts friction modification, antiwear, extreme pressure, antioxidant properties to the lubricant. The additive is a reaction product of any water-soluble inorganic molybdenum compound dissolved in the aqueous interior of a reversed microemulsion with hydrogen sulfide at an appropriate pH value to form a molybdenum sulfide derivative according to the following chemical reactions:

$$MoO_4^{-2} \xrightarrow{H_2S} MoO_3S^{-2} \xrightarrow{H_2S} MoO_2S_2^{-2} \xrightarrow{H_2S}$$

$$MoOS_3^{-2} \xrightarrow{H_2S} MoS_4^{-2}$$

$$MoOS_3^{-2} \xrightarrow{H^+} MoOS_2 + MoS_3$$

$$MoS_4^{-2} \xrightarrow{H^+} MoS_3$$

The approach of the present invention includes the formation of reverse microemulsions stabilized with one or more selected surfactants (e.g., tetralkylammonium salts) in a convenient solvent or solvent mixture wherein the mixture comprises the molybdenum salt solution in the interior of the reverse microemulsion. Subsequent interaction with $H_2S$ results in the formation of $MoS_3$ or $MoS_4^{-2}$ nanoparticles (depending on the pH value of the aqueous solution) in the interior of microemulsions. Further reaction with a long hydrocarbon chain-containing ligand such as a dialkyl amine, a dialkyl dithiocarbamate derivative, or the like provides modification of the nanoparticle surface, thereby fixing their size and shape and providing reasonable solubility and stability in hydrocarbon-type lubricating oils. In this approach the size and shape of modified $[MoS_x]$ nanoparticles are governed by the structure of the microemulsion and by the concentration of the respective molybdenum salts in the aqueous core of the microemulsion.

The following compounds are examples of water-soluble inorganic molybdenum compounds that can be used in the synthesis of the molybdenum sulfide derivatives:

Sodium tetrathiomolybdate $Na_2MoS_4$;

Ammonium tetrathiomolybdate $(NH_4)_2MoS_4$;

Sodium molybdate $Na_2MoO_4$;

Ammonium paramolybdate $(NH_4)_6Mo_7O_{24}$;

Molybdenum trioxide $MoO_3$;

and hydrates thereof.

The molybdenum sulfide derivatives formed according to the above reaction scheme in the interior of the reverse microemulsions represent a dispersion stabilized by one or more surfactants in one or more appropriate organic solvents. The surfactants that can be utilized in the practice of the present invention are oil-soluble cationic, anionic, and nonionic surfactants capable of formation of reverse microemulsions in non-polar solvents, such as paraffin, isoparaffin, aromatic or alkylaromatic hydrocarbons, halogenated hydrocarbons, or mixtures thereof.

The following compounds are examples of oil-soluble surfactants that can be used in the preparation of the reverse microemulsions:

Cationic Surfactants

Cetyltrimethylammonium bromide (CTAB, Fluka);

Tricaprylmethylammonium chloride (Aliquate® 336, Aldrich);

Methyltrialkyl($C_8$-$C_{10}$)ammonium chloride (Adogene®464, Aldrich);

Anionic Surfactants

Sodium bis(2-ethylhexyl)sulfosuccinate (AOT) (Fluka);

Nonionic Surfactants

Triton® X-100 (Aldrich);

Triton® X-114 (Aldrich).

In order to provide further flocculation stability, the molybdenum sulfide particles are capped with an appropriate surface-capping reagent in accordance with the following scheme:

$$nMoS_3 \xrightarrow{\text{aggregation}} [MoS_3]_n$$

$$[MoS_3]_n + mR{-}X \longrightarrow [MoS_3]_n(X{-}R)_m$$

The surface-capping reagents represented by the general formula R—X are selected from the compounds comprising a $C_2$-$C_{400}$ straight or branched-chain alkyl or alkylated cycloalkyl radical or radicals R and a functional group X that is capable of specific sorption and/or chemical interaction with a molybdenum sulfide moiety.

Examples of functional groups capable of specific sorption and/or chemical interaction with the molybdenum/sulfur moiety include amines, amides, imides, dithiocarbamates, thiuram disulfides, carboxy groups, and the like.

Preferably, (X—R) is selected from the group consisting of alkyl amines, dialkyl amines, trialkyl amines, carboxylic acids, dicarboxylic acids, carboxylic acid amides, dicarboxylic acid diamides, alicyclic imides, ammonium or alkali metal dialkyldithiocarbamates, divalent metal bis-dialkyldithiocarbamates, trivalent metal tris-dialkyldithiocarbamates, tetraalkyl thiuram disulfides, and derivatives thereof.

Preferably, the alkyl amines, dialkyl amines, and trialkyl amines are of the formula $$R^1R^2R^3N$$

wherein: $R^1$, $R^2$, and $R^3$ are independently selected from the group consisting of hydrogen, straight or branched-chain $C_1$-$C_{28}$ alkyl, $C_6$-$C_{34}$ alkylaryl, and aryl.

Preferably, the carboxylic acids, dicarboxylic acids, carboxylic acid amides, and dicarboxylic acid diamides are of the formula

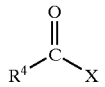

wherein X is OH, $NH_2$, $NHR^4$, or $NR^4R^4$ and $R^4$ is an straight or branched-chain, saturated or partially unsaturated, alkyl moiety of from 1 to 40 carbon atoms, e.g., methyl, ethyl, propyl, butyl, pentyl, hexyl, 2-ethylhexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof.

Preferably, the alicyclic imides are of the formula:

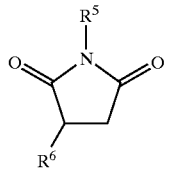

wherein $R^5$ is hydrogen, (C═O)$NHR^7$, or an alkylene amine wherein pairs of nitrogens are joined by alkylene groups, $R^6$ is hydrogen, straight or branched-chain ($C_2$-$C_{400}$)alkyl, and $R^7$ is H or ($C_1$-$C_{20}$)alkyl.

Preferably, the ammonium or alkali metal dialkyldithiocarbamates are of the formula

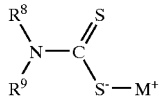

wherein $R^8$ and $R^9$ are independently selected from the group consisting of ($C_1$-$C_{24}$)alkyl and $M^+$ is $Na^+$, $K^+$, or $NH_4^+$.

Preferably, the divalent metal bis-dialkyldithiocarbamates are of the formula

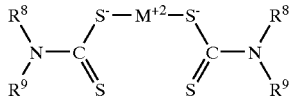

wherein $R^8$ and $R^9$ are selected from the group consisting of ($C_1$-$C_{24}$)alkyl and $M^{+2}$ is $Fe^{+2}$, $Zn^{+2}$, $Pb^{+2}$, or $Cu^{+2}$.

Preferably, the trivalent metal tris-dialkyldithiocarbamates are of the formula

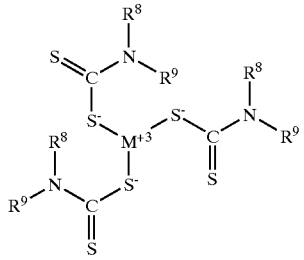

wherein $R^8$ and $R^9$ are selected from the group consisting of ($C_1$-$C_{24}$)alkyl and $M^{+3}$ is $Sb^{+3}$ or $Bi^{+3}$.

Preferably, the tetraalkyl thiuram disulfides are of the formula wherein $R^8$ and $R^9$ are independently selected from the group consisting of ($C_1$-$C_{24}$)alkyl.

The following compounds are examples of those that can be used to adsorb on and/or react with the surface of the molybdenum sulfide derivative nanosize particles of the present invention:

Sec-butyl amine;

Isopropyl(octadecyl)amine;

Docosanoic (behenic) acid ($C_{22}$ carboxylic acid) (Schuchardt, Munchen);

Alkenylsuccinimide (Polyisobutenylsuccinimide) (Uniroyal Chemical Co.);

Sodium di(2-ethylhexyl)dithiocarbamate;

Sodium di(hexadecyl)dithiocarbamate (Uniroyal Chemical Co.);

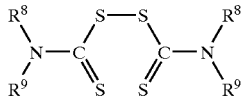

Tetra(2-ethylhexyl)thiuram disulfide;

Tetra(hexadecyl)thiuram disulfide (Uniroyal Chemical Co.).

The alkenylsuccinimides, as well as other ashless dispersants, useful in the practice of this invention are described below.

Various types of ashless dispersants (alkenylsuccinimides) can be made by functionalizing and/or derivatizing hydrocarbon polymers that are suitable for use in the lubricant compositions. The term "polymer" is used herein to refer to any hydrocarbon group, either branched or linear, containing 40–1500 carbon atoms. One of the most common types of polymer is polyisobutylene (PIB) based on a hydrocarbon chain of a number average molecular weight (Mn) of from about 500 to about 3000. Another type is based upon ethylene, alpha-olefin copolymer chains of a number average molecular weight (Mn) of from about 500 to about 25,000.

The polymers can be functionalized, by which is meant that they can be chemically modified to have at least one functional group present within their structures, which functional groups are capable of: (a) undergoing further chemical reaction (e.g. derivatization) with other materials and/or (b) imparting desirable properties, not otherwise possessed by the polymers alone, absent such chemical modification.

More specifically, the functional group(s) can be incorporated into the backbone of the polymer or as pendant groups from the polymer backbone. The functional group(s) typically will be polar and contain hetero atoms, such as P, O, S, N, halogen, and/or boron. They can be attached to the saturated hydrocarbon part of the polymers via substitution reactions or to an olefinic portion via addition or cycloaddition reactions. Alternatively, the functional group(s) can be incorporated into the polymer by oxidation or cleavage of a small portion of the end of the polymer (e.g., as in ozonolysis).

Functionalization of the polymer backbone with substituent functional groups typically relies on an ethylenic unsaturation, preferably a terminal ethylenic unsaturation, present in the polymer for reaction with a compound containing or constituting the functional group. Thus, reaction of these functional compounds and the polymer can occur through a variety of mechanisms. Useful and preferred functional groups include halogen, carboxyl materials present as acids, esters, salts, or anhydrides, alcohols, amines, ketones, aldehydes, and the like.

Useful functionalization reactions include, but are not limited to: maleation, i.e., the reaction of the polymer at the point of unsaturation with maleic acid or anhydride; halogenation of the polymer at the olefinic bond and subsequent reaction of the halogenated polymer with an ethylenically unsaturated functional compound; reaction of the polymer with an unsaturated functional compound by the "ene" reaction absent halogenation; reaction of the polymer with at least one phenol group, which permits derivatization in a Mannich Base-type condensation; reaction of the polymer at its point of unsaturation with carbon monoxide using a Koch-type reaction wherein an acid group, such as an iso acid or neo acid is formed; reaction of the polymer with the functional compound by free radical addition using a free radical catalyst; and reaction of the polymer by air oxidation methods, epoxidation, chloroamination, or ozonolysis.

The following are illustrative:

1. Reaction products of functionalized polymer derivatized with nucleophilic reagents, such as amine compounds, e.g. nitrogen-containing compounds; organic hydroxy-group-containing compounds, such as phenols and alcohols; and/or basic inorganic materials.

More specifically, nitrogen- or ester-containing ashless dispersants comprise oil-soluble salts, amides, imides, oxazolines, and esters, or mixtures thereof, of the polymer employed in the practice of the present invention, functionalized with mono- and dicarboxylic acids or anhydride or ester derivatives thereof, said polymer having dispersant range molecular weights as defined hereinabove.

At least one functionalized polymer is mixed with at least one of amine, alcohol, including polyol, aminoalcohol, and the like, to form the dispersant additives. One class of particularly preferred dispersants includes those derived from a polymer and functionalized mono- or dicarboxylic acid material, e.g., succinic anhydride, and reacted with (i) a hydroxy compound, e.g., pentaerythritol, (ii) a polyoxyalkylene polyamine, e.g., polyoxypropylene diamine, and/or (iii) a polyalkylene polyamine, e.g., polyethylene diamine or tetraethylene pentamine, referred to herein as TEPA. Another preferred dispersant class includes those derived from functionalized polymer reacted with (i) a polyalkylene polyamine, e.g., tetraethylene pentamine, and/or (ii) a polyhydric alcohol or polyhydroxy-substituted aliphatic primary amine, e.g., pentaerythritol or trismethylolaminomethane.

2. Reaction products of a hydrocarbon polymer functionalized with an aromatic hydroxy group and derivatized with aldehydes (especially formaldehyde) and amines (especially polyalkylene polyamines) through the Mannich reaction, which may be characterized as "Mannich dispersants".

3. Reaction products of a hydrocarbon polymer that have been functionalized by reaction with halogen and then derivatized by reaction with amines (e.g., direct amination), preferably, polyalkylene polyamines. These may be characterized as "amine dispersants" and examples thereof are described, for example, in U.S. Pat. Nos. 3,275,554; 3,438,757; 3,454,555; 3,565,804; 3,755,433; 3,822,209 and 5,084,197, the disclosures of which are herein incorporated by reference in their entirety.

Derivatized Polymer From Amine Compounds

Useful amine compounds for derivatizing functionalized hydrocarbon polymers comprise at least one amine and optionally, can comprise other reactive or polar groups. Where the functional group is a carboxylic acid, ester, or derivative thereof, it reacts with the amine to form an amide. Where the functional group is an epoxy, it reacts with the amine to form an amino alcohol. Where the functional group is a halide, the amine reacts to displace the halide. Where the functional group is a carbonyl group, it reacts with the amine to form an imine.

Amine compounds useful as nucleophilic reactants for reaction with the functionalized hydrocarbon polymer include those disclosed in U.S. Pat. Nos. 3,445,441; 5,017,299; and 5,102,566, all hereby incorporated herein by reference in their entirety. Preferred amine compounds include mono- and (preferably) polyamines, of about 2 to about 60, preferably about 2 to about 40, more preferably about 3 to about 20 total carbon atoms, and about 1 to about 12, preferably about 3 to about 12, and more preferably about 3 to about 9 nitrogen atoms in the molecule. These amines can be hydrocarbyl amines or can be hydrocarbyl amines that include other groups, e.g., hydroxy groups, alkoxy groups, amide groups, nitriles, imidazoline groups, and the like. Hydroxy amines having 1 to about 6 hydroxy groups, preferably 1 to about 3 hydroxy groups, are particularly useful. Preferred amines are aliphatic saturated amines, including those of the general formulae:

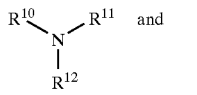

(I)

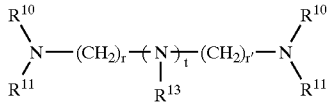

(II)

wherein $R^{10}$, $R^{11}$, $R^{12}$, and $R^{13}$ are independently selected from the group consisting of hydrogen, $C_1$ to $C_{25}$ straight or branched chain alkyl radicals, $C_1$ to $C_{12}$ alkoxy, $C_2$ to $C_6$ alkylene radicals, $C_2$ to $C_{12}$ hydroxy amino alkylene radicals, and $C_1$ to $C_{12}$ alkylamino $C_2$ to $C_6$ alkylene radicals, and wherein $R^{13}$ can additionally comprise a moiety of the formula:

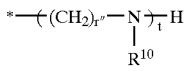

wherein $R^{10}$ is as defined above, and wherein r, r', and r" can be the same or a different integer of from 2 to 6, preferably 2 to 4; and t and t' can be the same or different integers of from 0 to 10, preferably 2 to 7, and more preferably about 3 to 7. Preferably, the sum of t and t' is not greater than 15. To assure a facile reaction, it is preferred that $R^{10}$, $R^{11}$, $R^{12}$, $R^{13}$, r, r', r", t, and t' be selected in a manner sufficient to provide the compounds of Formulae (I) and (II) with typically at least 1 primary or secondary amine group, preferably at least 2 primary or secondary amine groups. The most preferred amines of the above formulas are represented by Formula (II) and contain at least 2 primary amine groups and at least 1, and preferably at least 3, secondary amine groups.

Non-limiting examples of suitable amine compounds include: 1,2-diaminoethane; 1,3-diaminopropane; 1,4-diaminobutane; 1,6-diaminohexane; polyethylene amines, such as diethylene triamine, triethylene tetramine, tetraethylene pentamine; polypropylene amines, such as 1,2propylene diamine, di-(1,2-propylene)triamine, di-(1,3-propylene)triamine; N,N-dimethyl-1,3-diaminopropane; N,N-di(2-aminoethyl) ethylene diamine; N,N-di-(2-hydroxyethyl)-1,3-propylene diamine; 3-dodecyloxypropylamine; N-dodecyl-1,3-propane diamine; tris hydroxymethylaminomethane (THAM); diisopropanol amine; diethanol amine; triethanol amine; mono-, di-, and tri-tallow amines; amino morpholines, such as N-(3-aminopropyl)morpholine; and mixtures thereof. Monoamines include methyl ethyl amine, methyl octadecyl amines, anilines, diethylol amine, dipropyl amine, and the like.

Other useful amine compounds include: alicyclic diamines such as 1,4-di(aminomethyl) cyclohexane, and heterocyclic nitrogen compounds, such as imidazolines, and N-aminoalkyl piperazines of the general formula (III):

(III)

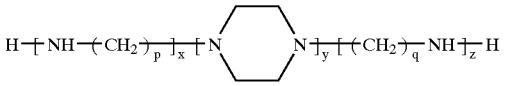

wherein p and q are the same or different and are each integers of from 1 to 4, and x, y, and z are the same or different and are each integers of from 1 to 3. Non-limiting examples of such amines include 2-pentadecyl imidazoline; N-(2-aminoethyl) piperazine; and the like.

Commercial mixtures of amine compounds can advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine, and isomeric piperazines. Low cost poly(ethyleneamine) compounds averaging about 5 to 7 nitrogen atoms per molecule are available commercially under designations such as "Polyamine H", "Polyamine 400", "Dow Polyamine E-100", etc.

Useful amines also include polyoxyalkylene polyamines, such as those of the formula:

$$NH_2\text{-alkylene-}(\text{—O-alkylene-})_m\text{-}NH_2 \quad (IV)$$

where m has a value of about 3 to 70, preferably 10 to 35; and the formula:

$$R^{14}\text{-}(\text{-alkylene-}(\text{—O-alkylene-})_n\text{-}NH_2)_3 \quad (V)$$

where n has a value of about 1 to 40 with the provision that the sum of all the n values is from about 3 to about 70 and preferably from about 6 to about 35, and $R^{14}$ is a polyvalent saturated hydrocarbon radical of up to 10 carbon atoms wherein the number of substituents on the $R^{14}$ group is represented by the value of "a", which is an integer of from 3 to 6. The alkylene groups in either formula (IV) or (V) can be straight or branched chains containing about 2 to about 7, and preferably about about 2 to about 4 carbon atoms.

The polyoxyalkylene polyamines of formulas (IV) or (V) above, preferably polyoxyalkylene diamines and polyoxyalkylene triamines, can have number average molecular weights ranging from about 200 to about 4,000 and preferably from about 400 to about 2,000. The preferred polyoxyalkylene polyamines include the polyoxyethylene and polyoxypropylene diamines and the polyoxypropylene triamines having average molecular weights ranging from about 200 to 2,000. The polyoxyalkylene polyamines are commercially available and can be obtained, for example, from the Huntsman Chemical Company, Inc. under the trade designations "Jeffamines D-230, D-400, D-1000, D-2000, T-403, etc. Other suitable amines include bis(paraamino cyclohexyl) methane oligomers.

Thiuram Disulfides and Thiocarbamate Salts

The thiocarbamate salts useful in the practice of the present invention are characterized in that the alkali metal dialkyldithiocarbamate represents a compound of the formula

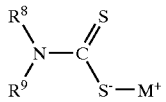

wherein $R^8$ and $R^9$ are independently selected from the group consisting of $(C_1\text{-}C_{24})$alkyl and $M^+$ is $Na^+$, $K^+$, or $NH_4^+$.

Also useful are the divalent metal bis-dialkyldithiocarbamates of the formula

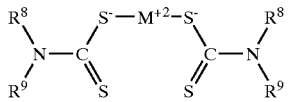

wherein $R^8$ and $R^9$ are selected from the group consisting of $(C_1\text{-}C_{24})$alkyl and $M^{+2}$ is $Fe^{+2}$, $Zn^{+2}$, $Pb^{+2}$, or $Cu^{+2}$.

Also useful are the trivalent metal tris-dialkyldithiocarbamates of the formula

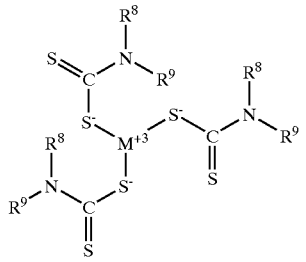

wherein $R^8$ and $R^9$ are selected from the group consisting of $(C_1\text{-}C_{24})$alkyl and $M^{+3}$ is $Sb^{+3}$ or $Bi^{+3}$.

Thiuram disulfides useful for this invention are of the formula:

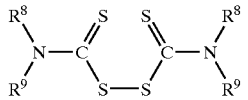

wherein $R^8$ and $R^9$ are as described above.

Examples of thiuram disulfides and their synthesis useful for this invention are disclosed in U.S. Pat. No. 4,501,678, the disclosure of which is herein incorporated by reference in its entirety. Examples of thiocarbamate salts and their synthesis useful for this invention are disclosed in U.S. Pat. Nos. 3,674,824; 3,678,135, the disclosures of which are herein incorporated by reference in their entirety.

General Synthesis of Additives

The process for making the molybdenum based friction modifiers of the present invention is unique in its simplicity and appearance. This process includes the steps of:

i) creating a micelle solution of a suitable surfactant in an organic solvent or solvent mixture, ii) creating a reverse microemulsion by addition of an aqueous solution of an appropriate water-soluble inorganic molybdenum compound to the micelle solution, iii) adding an appropriate surface-capping reagent capable of adsorbing on or reacting with molybdenum sulfide, iv) reacting the molybdenum compound in the aqueous microemulsion core with hydrogen sulfide to form a thiomolybdenum derivative, v) removing water and organic solvents from the reaction mixture, vi) extracting molybdenum/sulfur moiety-containing nanosized particles thus formed with an appropriate solvent, and vii) evaporating the appropriate organic solvent to yield the additive in the form of surface-capped nanosized particles.

Creating a Reverse Micelle Solution and Reverse Microemulsion

Generally, the reverse micellar solutions formed by any surfactant type (cationic, anionic, or nonionic) can form a reverse microemulsion on addition of an aqueous solution of any inorganic salt. The reverse micellar solutions stabilized by various types of surfactants as well as the reverse microemulsion made from said micellar solutions within the scope of the present invention are presented in Table 1. The surfactants useful in this invention include:

i) cationic type: tetraalkylammonium halides, such as cetyltrimethylammonium bromide (CTAB); tricapryl-methylammonium chloride (Aliquate® 336, AL-336); methyltrialkyl$(C_8\text{-}C_{10})$ammonium chloride (Adogen® 464, AD-464);

ii) anionic type: sodium bis(2-ethylhexyl)sulfosuccinate (AOT);

iii) nonionic type: Triton® X-100 (TX-100); Triton® X-100 reduced (TX-100R).

TABLE 1

| No. of solution | Surfactant (concentration, mol/L) | Organic solvent/solvent mixture, mL | Amount of added aqueous salt solution | Result |
|---|---|---|---|---|
| 1 | CTAB (0.01) | Chloroform-hexane (1:1 v/v), 10 | 15 μl of 30 wt. % $(NH_4)_6Mo_7O_{24}.4H_2O$ | Clear solution |
| 2 | CTAB (0.001) | Chloroform-isooctane (1:1 v/v), 10 | 5 μl of 40 wt. % $(NH_4)_6Mo_7O_{24}.4H_2O$ | Clear solution |
| 3 | CTAB (0.1) | Chloroform-isooctane (1:1 v/v), 10 | 35 μl of 40 wt. % $(NH_4)_6Mo_7O_{24}.4H_2O$ | Clear solution |
| 4 | AL-336 (0.25) | Benzene, 5 | 4 μl of 5 wt. % $(NH_4)_6Mo_7O_{24}.4H_2O$ | Clear solution |
| 5 | AL-336 (0.25) | Chloroform, 5 | 2 μl of 5 wt. % $(NH_4)_6Mo_7O_{24}.4H_2O$ | Clear solution |
| 6 | AL-336 (0.055) | Benzene, 5 | 5 μl of 10 wt. % $(NH_4)_6Mo_7O_{24}.4H_2O$ | Clear solution |
| 7 | AD-464 (0.11) | Benzene, 5 | 6 μl of 10 wt. % $(NH_4)_6Mo_7O_{24}.4H_2O$ | Clear solution |
| 8 | AD-464 (0.11) | Chloroform, 5 | 4 μl of 10 wt. % $(NH_4)_6Mo_7O_{24}.4H_2O$ | Clear solution |
| 9 | AOT (0.21) | Chloroform, 5 | 20 μl of 2 wt. % $(NH_4)_6Mo_7O_{24}.4H_2O$ | Clear solution |
| 10 | AOT (0.19) | Chloroform-isooctane (1:1 v/v), 5 | 10 μl of 2 wt. % $Na_2MoO_4$ | Clear solution |
| 11 | AOT (0.15) | Isooctane, 5 | 10 μl of 2 wt. % $Na_2MoO_4$ | Clear solution |
| 12 | TX-100 (0.10) | Benzene, 5 | 2 μl of 10 wt. % $Na_2MoO_4$ | Clear solution |

TABLE 1-continued

| No. of solution | Surfactant (concentration, mol/L) | Organic solvent/solvent mixture, mL | Amount of added aqueous salt solution | Result |
|---|---|---|---|---|
| 13 | TX-100 (0.10) | Benzene-hexane (1:3 v/v), 5 | 2 μl of 2 wt. % $Na_2MoO_4$ | Clear solution |
| 14 | TX-100R (0.10) | Cyclohexane, 5 | 3 μl of 5 wt. % $Na_7MoO_4$ | Clear solution |
| 15 | TX-100R (0.10) | Benzene-hexane (1:3 v/v), 5 | 2 μl of 1 wt. % $Na_2MoO_4$ | Clear solution |

Preferably, CTAB is employed dissolved in chloroform:n-alkane in a concentration of about 0.01 to about 0.1 mol/L. The n-alkanes that can be used include, but are not limited to, pentane, hexane, heptane, octane, and isomers and mixtures thereof.

Reacting a Molybdenum Compound in the Microemulsion Aqueous Core with Hydrogen Sulfide The reverse microemulsions containing molybdate salt solutions that do not include a sulfur atom are reacted with hydrogen sulfide ($H_2S$) by bubbling gaseous hydrogen sulfide directly into the microemulsion. The reaction proceeds similarly to that in aqueous solution, i.e., by stepwise substitution for oxygen atoms in molybdate anion. Depending on pH value, either thiomolybdate anions at pH 7 or higher (step-by-step substitution) that are soluble in water or $MoS_3$ sediment at pH lower than 7 are formed. Interaction of the molybdate-containing microemulsions was monitored by UV spectra in order to clarify the influence of reaction conditions on its result. Typically, $[MoS_4]^{2-}$ anions have absorption bands at 241 nm, 316 nm, and 467 nm; $[MoOS_3]^{2-}$—at 308 nm, 396 nm and 457 nm; $[MoO_2S_2]^{2-}$—at 320 nm and 393 nm, respectively, in water.

Figure 2:
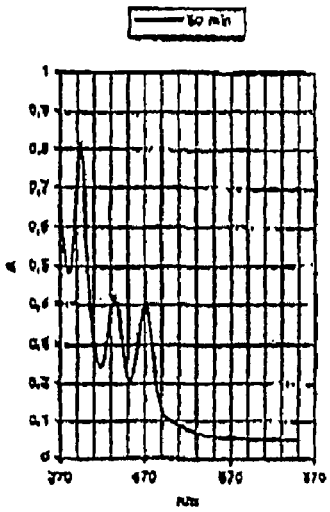
Figure 3:
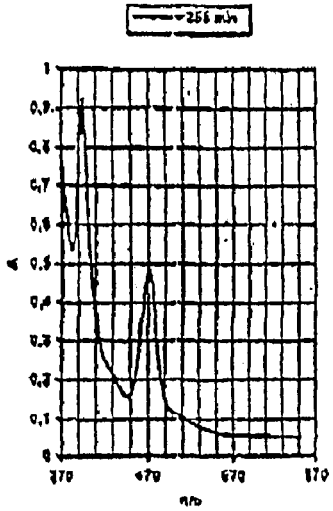
Figure 4:
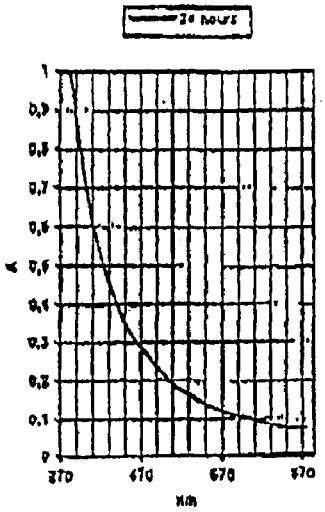
FIG. 4 is a UV spectrum containing no absorption bands, which is typical of the spectra of nanosized inorganic particles formed in the interior of reverse micelles.

UV spectra presented in FIGS. 1–3 are illustrative of formation of a partially substituted thiomolybdate derivative. The final spectrum in FIG. 4 contains no absorption bands and is typical of UV spectra of nanosized inorganic particles formed in the interior of the reverse micelles.

Depending on the pH value of the aqueous solution, the reaction of the molybdenum (VI) compound with hydrogen sulfide may proceed either to form thiomolybdate salt derivatives, as supported by spectra presented at FIGS. 1–3 (pH $\geqq 5$), or to form $MoOS_2$ or $MoS_3$ sediments directly within the microemulsion aqueous core at pH <5. Adjustment of the pH value of the solution is achieved by addition of a desired amount of hydrochloric acid directly to the microemulsion containing molybdenum derivatives solution and before reaction with hydrogen sulfide.

Adding an Appropriate Surface Capping Agent to Molybdenum Sulfide Nanoparticles Nanosize particles of inorganic material often possess limited flocculation and/or sedimentation stability in an organic medium. Utilization of a surface-capping agent to improve the flocculation stability is known in the art; however, none of the surface-capped nanosize inorganic particles may be dissolved in a non-polar organic medium.

Molybdenum sulfides readily form complex compounds with a number of compounds, such as organic amines, carboxylic acids, dialkyldithiophosphoric acid derivatives, and dialkyldithiocarbamic acid derivatives. The present invention is directed to the utilization of these groups of compounds for the surface-capping of molybdenum sulfide nanoparticles in order to enhance their flocculation stability and to solubilize them in non-polar organic solvents, such as hydrocarbons and petroleum-originated lubricating oils.

Figure 5:
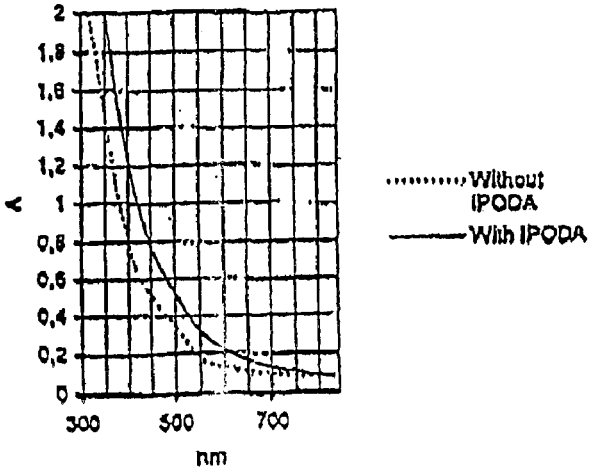
FIG. 5 is the UV spectrum of molybdenum sulfide nanoparticles prepared in the presence of isopropyloctadecyl amine.

Surface-capping of molybdenum/sulfur moiety-containing nanoparticles, according to the present invention, can be performed by the addition of a desired amount of the surface-capping agent either before formation of a reverse microemulsion, after the formation of a reverse microemulsion, or even after the reaction of the molybdenum derivative in the aqueous core of the microemulsion with hydrogen sulfide. Addition of the surface-capping agents does not affect the course of the chemical reaction in the interior of the reverse microemulsion, and the resulting spectra for nanosize molybdenum sulfide particles are practically the same as those obtained in the absence of any surface capped agents, e.g., see the UV spectrum of molybdenum sulfide nanoparticles prepared in the presence of isopropyloctadecyl amine, presented in FIG. 5.

Removing Water and Organic Solvents from the Reaction Mixture, and Extracting the Molybdenum Sulfide Nanosized Particles The solution obtained in the previous step, which is clear brown, contains surface-capped molybdenum sulfide nanoparticles, surfactant, water, and organic solvent and/or solvent mixture. Water and organic solvents and/or solvent mixtures are readily removed by evaporation and vacuum drying of the residue, while isolation of the surface-capped molybdenum sulfide nanoparticles is achieved by selective extraction with an appropriate solvent. For example, in the case of cationic surfactants, the suitable solvent is tetrahydrofuran (THF), which does not dissolve any significant amount of tetraalkylammonium halide surfactant, but extracts the final surface-capped molybdenum sulfide nanosize particles. Evaporation of THF yields the desired compounds of this invention.

Final additives of this invention are usually prepared by dissolving the synthesized surface-capped molybdenum sulfide nanosize particles in the corresponding surface-capping agent of this invention so as to form an additive concentrate suitable for blending with a lubricant oil of any type: petroleum-based or synthetic comprising synthetic hydrocarbons, diesters, polyol esters, alkylaromatic compounds, silicone-based oils, polyphenyl ether, fluorinated hydrocarbons, and the like.

Use with Other Additives

The additive of this invention can be used in combination with other additives typically found in lubricating compositions, as well as with other friction modifier additives. The typical additives found in lubricating oils are dispersants, detergents, rust inhibitors, antioxidants, antiwear agents, anti-foamants, friction modifiers, seal swell agents, demulsifiers, VI improvers, and pour point depressants. See, e.g. U.S. Pat. No. 5,498,809 for a description of useful lubricating oil composition additives. Examples of dispersants include polyisobutylene succinimides, polyisobutylene succinate esters, Mannich Base ashless dispersants, and the like. Examples of detergents include metallic phenates, metallic sulfonates, metallic salicylates, and the like. Examples of antioxidant additives that can be used in combination with the additives of the present invention include alkylated diphenylamines, N-alkylated phenylenediamines, hindered phenolics, alkylated hydroquinones, hydroxylated thiodiphenyl ethers, alkylidenebisphenols, oil soluble copper compounds, and the like. Examples of anti-wear additives that can be used in combination with the additives of the present invention include organo borates, organo phosphites, organic sulfur-containing compounds, zinc dialkyl dithiophosphates, zinc diaryl dithiophosphates, phosphosulfurized hydrocarbon, and the like. Examples of friction modifiers that can be used in combination with the friction modifiers of the present invention include fatty acid esters and amides, organo molybdenum compounds, molybdenum dialkylthiocarbamates, molybdenum dialkyl dithiophosphates, and the like. An example of an antifoamant is polysiloxane, and the like. Exemplary of rust inhibitors are the polyoxyalkylene polyols, and the like. Examples of VI improvers include olefin copolymers and dispersant olefin copolymers, and the like. An example of a pour point depressant is polymethacrylate, and the like.

Lubricant Compositions

Compositions, when containing these additives, typically are blended into the base oil in amounts that are effective to provide their normal attendant function.

| Compositions | Broad Weight % | Preferred Weight % |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergents/Rust Inhibitors | 0.01–6 | 0.01–3 |
| Pour Point Depressant | 0.01–1.5 | 0.01–0.5 |
| Antifoaming Agents | 0.001–0.1 | 0.001–0.01 |
| Antiwear Agents | 0.001–5 | 0.001–1.5 |
| Seal Swellant | 0.1–8 | 0.1–4 |
| Friction Modifiers | 0.01–3 | 0.01–1.5 |
| Lubricating Base Oil | Balance | Balance |

The additives of the present invention would be substituted for a portion of the friction modifier, and/or the oxidation inhibitor, and/or the anti-wear agent.

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of typically from about 2.5 to about 90%, and preferably from about 15 to about 75%, and more preferably from about 25 to about 60% by weight additives in the appropriate proportions with the remainder being base oil. The final formulations may employ typically about 1–20 wt. % of the additive-package with the remainder being base oil.

All of the weight percentages expressed herein (unless otherwise indicated) are based on active ingredient (AI) content of the additive, and/or upon the total weight of any additive-package or formulation that will be the sum of the (AI) weight of each additive plus the weight of total oil or diluent.

In general, the lubricant compositions of the present invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil basestocks. The lubricating oil basestock is any natural or synthetic lubricating base oil stock fraction having a kinematic viscosity at 100° C. of about 2 to about 200 cSt, more preferably about 3 to about 150 cSt, most preferably about 3 to about 100 cSt. The lubricating oil basestock can be derived from natural lubricating oils, synthetic lubricating oils, or mixtures thereof. suitable lubricating oil basestocks include basestocks obtained by isomerization of synthetic wax and wax, as well as hydrocrackate basestocks produced by hydrocracking (rather than solvent extracting) the aromatic and polar components of the crude. Natural lubricating oils include animal oils, vegetable oils (e.g., rapeseed oils, castor oils and lard oil), petroleum oils, mineral oils, and oils derived from coal or shale.

Synthetic oils include hydrocarbon oils and halo-substituted hydrocarbon oils, such as polymerized and interpolymerized olefins, alkylbenzenes, polyphenyls, alkylated diphenyl ethers, alkylated diphenyl ethers, alkylated diphenyl sulfides, as well as their derivatives, analogs and homologs thereof, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax can also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and, following dewaxing, a pour point of about −20° C. and lower.

The additives of the present invention are especially useful as components in many different lubricating oil compositions. The additives can be included in a variety of oils with lubricating viscosity including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel (both gasoline and diesel) compositions.

The advantages and the important features of the present invention will be more apparent from the following examples.

EXAMPLES

Preparation of Surface-Capped Molybdenum Sulfide Nanoparticles Using Various Surface-Capping Agents

Organic Amine Modification

Example 1

Isopropyloctadecylamine (IPODA)

Cetyltrimethylammonium bromide (0.652 g) was dissolved in 45 mL of chloroform and 100 μL of a saturated aqueous solution of $(NH_4)_6Mo_7O_{24}.2H_2O$ was added with stirring. The opaque solution was heated, then 20 mL of isooctane and 20 mL of chloroform were added, and 10 drops of concentrated aqueous HCl solution, resulting in a clear solution. Excess $H_2S$ was bubbled in until a weak yellow color was obtained, then 11 mL of a solution obtained by dissolving 0.577 g of isopropyloctadecylamine in 50 mL of chloroform (Mo:N~1:5) was added. Three days later, all solvents were evaporated from the resulting dark solution containing small sediment, the residue was stirred with 30 mL tetrahydrofuran (THF), undissolved cetyltrimethylammonium bromide (CTAB) containing some $MoS_3$ was filtered off, and the resulted dark clear solution was evaporated.

Example 2 sec.-Butylamine

CTAB (0.757 g) was dissolved in 100 mL of chloroform and diluted with 100 mL of hexane. One hundred mL of saturated aqueous solution of $(NH_4)_6Mo_7O_{24}.2H_2O$ was added with stirring, followed by 12 μL of concentrated aqueous HCl solution, which resulted in a clear solution. $H_2S$ was bubbled in over a one hour period until the color became gray-brown, then 30 μL of sec.-butylamine was added, whereupon the solution became a deep brown. Twenty-four hours later, all the solvents were evaporated from the dark solution, the residue was stirred with 15 mL of tetrahydrofuran (THF), undissolved CTAB containing some $MoS_3$ was filtered off, and the resulting dark clear solution was evaporated to yield 0.1279 g of a dark substance.

Example 3

Alkenyl Succinimide

Alkenyl succinimide (ASI, 1.7 mL) (the reaction product of Indapol H-1500 (polyisobutylene) with maleic anhydride, which is then reacted with triethylenetetraamine (TETA), (Uniroyal Chemical Company) solution (0.2185 g ASI in 5 mL chloroform) was dissolved in 100 mL of a 0.01M solution of CTAB in chloroform-hexane solution (1:1 v/v) with stirring. After 10 minutes, 0.05 mL of a saturated aqueous solution of $(NH_4)_6Mo_7O_{24}$ was added to produce an opaque microemulsion (ASI:Mo=1,6:1.1 by moles). Addition of approximately 8.5 μL of concentrated aqueous HCl resulted in a clear solution, into which excess $H_2S$ was bubbled. The color of the solution changed from green to brown and, after 24 hours, a brown precipitate formed. Organic solvents were evaporated under vacuum, the residue was stirred with 15 mL of freshly distilled THF, the undissolved matter was filtered off, and the THF was evaporated. The resulting residual brown substance (0.0523 g) was nanosized molybdenum sulfide particles modified with ASI in a modifier to Mo ratio of approximately 1:1.

Example 4

Alkenyl Succinimide

Alkenyl succinimide solution (0.85 mL of 0.2185 g ASI in 5 mL chloroform) was dissolved in 100 mL 0.01M solution of CTAB in a chloroform-hexane solution (1:1 v/v) with stirring. After 10 minutes, 0.05 mL of a saturated aqueous solution of $(NH_4)_6Mo_7O_{24}$ was added to produce an opaque microemulsion (ASI:Me=0.56:1.1 by moles). Addition of approximately 7 μL of concentrated aqueous HCl resulted in a clear solution, into which excess $H_2S$ was bubbled. The solution turned opaque and its color changed from greenish to brown. After 24 hours the solution was still opaque and brown and no precipitate had formed. The organic solvents were evaporated under vacuum, the residue was stirred with 15 mL of freshly distilled THF, the undissolved matter was filtered off, and the THF was evaporated. The residual brown substance (0.04 g) was nanosized molybdenum sulfide particles modified with ASI in a modifier to Mo ratio of approximately 1:2.

Example 5

Alkenyl Succinimide

A saturated aqueous solution of $(NH_4)_6Mo_7O_{24}$ (0.05 mL) was added to 100 mL 0.01M CTAB solution in a chloroform-hexane mixture (1:1 v/v). After 5 minutes, 1.7 mL of alkenyl succinimide solution (0.2185 g of ASI in 5 mL chloroform) was added to produce a colorless opaque microemulsion (ASI:Me=1.6:1.1 by moles). The addition of approximately 6 $\mu$L of concentrated aqueous HCl resulted in a clear solution, into which excess $H_2S$ was bubbled. The solution slowly turned brown. After 24 hours, the organic solvents were evaporated under vacuum, the residue was stirred with 15 mL of freshly distilled THF, the undissolved matter was filtered off, and the THF was evaporated. The residual brown substance (0.094 g) was nanosized molybdenum sulfide particles modified with ASI in a modifier to Mo ratio of approximately 1:1.

Example 6

Alkenyl Succinimide

Example 5 was repeated except that the ASI solution was added to the CTAB solution first, and then the saturated aqueous solution of $(NH_4)_6Mo_7O_{24}$ was added. Hydrogen sulfide was bubbled in over a period of approximately 2.5 hours. Product isolation resulted in 0.1052 g of nanosized molybdenum sulfide particles modified with ASI in a modifier to Mo ratio of approximately 1:1.

Carboxylic Acid Modification

Example 7

Docosanoic (behenic) acid; $C_{22}$ carboxylic acid

Seven $\mu$L of saturated aqueous ammonium molybdate solution was added with stirring to 7 mL of 0.01 mol/L CTAB solution in a 1:1 v/v isooctane-chloroform mixture, then the mixture was stabilized by addition of concentrated aqueous HCl (1 drop). After 30 minutes, $H_2S$ was bubbled into the slightly blue solution turning it yellow, and 0.19 mL of a solution containing 0.0282 g behenic acid in 5 mL of chloroform was added. Excess $H_2S$ was further bubbled in. After 24 hours, a light brown sediment formed The residue, after removing all solvents, dissolved in chloroform and benzene (except for CTAB, in the latter case).

Example 8

Docosanoic (behenic) Acid

Two mL of behenic acid solution (0.2165 g of behenic acid in 10 mL of chloroform) was dissolved in 100 mL of 0.01M solution of CTAB in chloroform-hexane solution (1:1 v/v) with stirring. After 10 minutes, 0.05 mL of a saturated aqueous solution of $(NH_4)_6Mo_7O_{24}$ was added, producing an opaque microemulsion ($C_{22}$ acid:Mo=1;1.3 by moles). Addition of approximately 5.5 $\mu$L of concentrated aqueous HCl resulted in a clear solution, into which excess $H_2S$ was bubbled for 2.5 hours. The color of the solution changed from green to brown. After 24 hours, the organic solvents were evaporated in vacuum, the residue was stirred with 15 mL of freshly distilled THF, the undissolved matter was filtered off, and the THF was evaporated. A residual brown substance (0.037 g) resulted, representing nanosized molybdenum sulfide particles modified with behenic acid in a modifier to Mo ratio of approximately 1:1.3.

Dialkyldithiophosphoric Acid Derivatives Modification

Example 9

Di-2-ethylhexyl-dithiophosphoric Acid

Fifty mL of aqueous saturated ammonium molybdate solution was added to 10 mL of 0.01 mol/L CTAB solution in isooctane-chloroform in a 1:1 v/v mixture under reflux, followed by 75 $\mu$L of concentrated aqueous HCl . Then 0.07 $\mu$L of a solution containing 0.1 g di-2-ethylhexyl-dithiophosphoric acid in 2 mL chloroform was added (10 molar % relative to Mo) and excess $H_2S$ bubbled in. Twenty-four hours later, a sediment was formed that was isolated by filtration. The dark-brown solid thus obtained dissolves in chloroform, THF, and slightly in benzene, $CCl_4$ and sec. —$C_4H_9NH_2$.

Dialkyldithiocarbamic Acid Derivatives Modification

Example 10

Tetra(hexadecyl)thiuram Disulfide

Tetra(hexadecyl)thiuram disulfide (THDTS) solution. (1.5 mL of 0.204 g THDTS in 5 mL of chloroform) was dissolved in 100 mL of a 0.01M solution of CTAB in chloroform-hexane solution (1:1 v/v) with stirring. After 10 minutes, 0.05 mL of a saturated aqueous solution of $(NH_4)_6Mo_7O_{24}$ was added to produce an opaque microemulsion (THDTS:Mo=1:1 by moles). Addition of approximately 5 $\mu$L of concentrated aqueous HCl resulted in a clear solution, and excess $H_2S$ (about 300 mL) was bubbled in. The solution's color changed from light-brown to dark green-brown. After 24 hours, no visible precipitate had formed in the solution. The organic solvents were evaporated under vacuum, the residue was stirred with 15 mL of freshly distilled THF, the undissolved matter was filtered off, and the THF was evaporated. The residual brown substance (0.0673 g) was nanosized molybdenum sulfide particles modified with THDTS in a modifier to Mo ratio of approximately 1:1. The whole sample completely dissolves in 3 mL benzene.

Example 11

Sodium di(hexadecyl)dithiocarbamate

Sodium di(hexadecyl)dithiocarbamate (NaHDTC) solution (1.5 mL of 0.204 g NaHDTC in 5 mL chloroform) eras dissolved in 100 mL of a 0.01M solution of CTAB in chloroform-hexane solution (1:1 v/v) with stirring. After 10 minutes, 0.05 mL of a saturated aqueous solution of $(NH_4)_6Mo_7O_{24}$ was added to produce a light-yellow solution (NaHDTC:Mo=1:1 by moles). Addition of approximately 2.5 $\mu$L of concentrated aqueous HCl resulted in a clear solution, and excess $H_2S$ (about 300 mL) was bubbled in. The solution's, color changed to yellow-brown. After 24 hours, no visible precipitate had formed in the solution. The organic solvents were evaporated under vacuum, the residue was stirred with 15 mL of freshly distilled THF, the undissolved matter was filtered off, and the THF was evaporated. The residual brown substance (0.043 g) was nanosized molybdenum sulfide particles modified with NaHDTC in a modifier to Mo ratio of approximately 1:1. The whole sample completely dissolves in 5 mL benzene.

Preparation of Additives and of Lubricant Compositions

Example 12

Lubricant Composition A

The sample obtained in Example 1 was dissolved in 0.2 g ASI on heating to about 60° C., and 5 mL of T46 oil was added. The solution was filtered to produce a dark-brown composition containing about 5 wt. % of the additive package.

Example 13

Lubricant Composition H

The sample obtained in Example 2 was dissolved in 0.2 g ASI on heating to about 60° C., and 5 mL of T46 oil was added. The solution was filtered to produce a dark-brown composition containing about 5 wt. % of the additive package.

Example 14

Lubricant Composition C

The sample obtained in Example 3 was dissolved in 0.2 g ASI on heating to about 60° C., and 5 mL of T46 oil was added. The solution was filtered to produce a dark-brown composition containing about 5 wt. % of the additive package.

Example 15

Lubricant Composition D

The sample obtained in Example 4 was dissolved in 0.2 g ASI on heating to about 60° C., and 5 mL of T46 oil was added. The solution was filtered to produce a dark-brown composition containing about 5 wt. % of the additive package.

Example 16

Lubricant Composition E

The sample obtained in Example 5 was dissolved in 0.07 g ASI on heating to about 60° C. An additional 0.06 g ASI was added to improve solubility, although some solid particulate material remained, which was later filtered off Then 1.6 mL of T46 oil was added. The solution was filtered to produce a dark-brown composition containing less than about 10 wt % of the additive package.

Example 17

Lubricant Composition F

The sample obtained in Example 6 was dissolved in 0.132 g ASI on heating to about 60° C. and 4.486 mL of T46 oil was added. The solution was filtered to produce a dark-brown composition containing about 5 wt. % of the additive package.

Example 18

Lubricant Composition G

The sample obtained in Example 7 was dissolved in 0.16 g ASI on heating to about 60° C., and 5 mL of T46 oil was added. The solution was filtered to produce a dark-brown composition containing about 5 wt % of the additive package.

Example 19

Lubricant Composition H

The sample obtained in Example 7 was dissolved in 0.149 g ASI on heating to about 60° C., and 4.7 mL T46 oil was added on heating to about 60° C. Some solid particulate material was later filtered off. The warm solution was clear, but cooling to ambient temperature resulted in sediment formation. This sample was not tested.

Example 20

Lubricant Composition I

The sample obtained in Example 8 was dissolved in 0.2 g ASI on heating to about 60° C., and 5 mL T46 oil was added. The solution was filtered to produce a dark-brown composition containing about 5 wt. % of the additive package.

Example 21

Lubricant Composition J

The sample obtained in Example 9 was dissolved in 0.2 g ASI on heating to about 60° C., and 5 mL of T46 oil was added. The solution was filtered to produce a dark-brown composition containing about 5 wt. % of the additive package,

Example 22

Lubricant Composition K

The sample obtained in Example 10 was dissolved in 0.2 g ASI on heating to about 60° C., and 5 mL of T46 oil was added. The solution was filtered to produce a dark-brown composition containing about 5 wt. % of the additive package.

Example 23

Lubricant Composition L

The sample obtained in Example 11 was dissolved in 0.2 g ASI on heating to about 60° C., and 5 mL of T46 oil was added. The solution was filtered to produce a dark brown composition containing about 5 wt % of the additive package.

SRV Tribometer Determination of Friction Coefficient and Antiscuffing Properties Friction coefficient measurements were performed using SRV vibration tribometer (Optimol Instruments GmbH, Germany) for the ball-area pair (friction point) at 50 MHz, stepwise loading from 20 to 1000 N. Friction coefficient versus load value was measured, as well as load-carrying ability of the lubricant tested. Better results are assumed to be those demonstrating a lower value of friction coefficient and a higher value of scuffing load.

Lubricant compositions containing the surface-capped nanosized molybdenum sulfide particles were prepared on the basis of Turbine Oil T46 and included different amounts of the molybdenum-containing additives. Tribological properties of the lubricant compositions of this invention are compared with those of a composition containing 1 wt. % of molybdenum oxosulfo-(diisooctyldithiocarbamate) complex (Composition M), see Zaimovskaya T. A. et al. *Izv. AN SSSR Ser. Khim., No.5*:2151 (1991).

The test results are presented in Table 2.

TABLE 2

| Composition | Scuffing Load, N | Lowest Friction Coefficient Value |
|---|---|---|
| A | 800 | 0.098 |
| B | 800 | 0.098 |
| C | 900 | 0.097 |
| D | 1000 | 0.097 |
| E | 800 | 0.098 |
| F | 700 | 0.100 |
| G | 900 | 0.099 |
| H | 900 | 0.098 |
| I | 1000 | 0.097 |
| J | 1000 | 0.097 |
| K | 800 | 0.099 |
| L | 900 | 0.097 |
| M (comparative) | 700 | 0.100 |

Example 24

Alkenyl Succinimide

Cetyltrimethylammonium bromide (CTAB) (0.757 g, 0.02 mol) was dissolved in 100 mL in $CHCl_3$, stirred for a period of 15 minutes, and then the mixture was diluted with 100 mL hexane (solution A). Alkenyl succinimide (0.2188 g) was dissolved in 2 mL of $CHCl_3$ (solution B). Freshly re-crystallized salt $(NH_4)_6Mo_7O_{24}$ was dissolved in distilled water to give a saturated solution (room temperature, approx. 40% by weight) (solution C). A quantity of 1.327 mL of solution B (approx. $2.2\times10^{-4}$ mol) was added with stirring to solution A. Ten minutes later, 100 $\mu$L of solution C (approx. $2.8\times10^{-5}$ mol of salt, $1.93\times10^{-4}$ mol Mo) was added using a microsyringe. Finally, 0.2 mL of hydrochloric acid (36% by weight, $2\times10^{-3}$ mol) was added. The solution thus obtained was clear and colorless. An excess of $H_2S$ was bubbled through the resultant solution over a period of 2.5 hours, Sixteen hours later (the next day) all volatile matter was removed under reduced pressure and the solid residue was dried under reduced pressure (0.1 mm Hg). Ten mL of freshly distilled tetrahydrofuran (THF) was added to the residue and the mixture was filtered through a porous glass filter (precipitate left on filter (CTAB) was white). The resultant dark-brown solution was evaporated to dryness under reduced pressure (temperature less than 60° C.) and dried to give 0.1505 g of a dark-brown substance. Alkenyl succinimide (0.301 g) was added to the residue and the entire mixture was heated to 60° C. and thoroughly mixed manually using a glass rod. This product was tested in the Cameron-Plint machine after being formulated into an engine oil.

Example 25

Alkenyl Succinimide

Cetyltrimethylammonium bromide (CTAB) (1.1355 g, 0.03 mol) was dissolved in 150 mL $CHCl_3$, stirred for a period of 15 minutes and the mixture was diluted with 150 mL of hexane (solution AA). Alkenyl succinimide (0.4370 g) was dissolved in 4 mL of $CHCl_3$ (solution BB). Freshly re-crystallized salt, $(NH_4)_6Mo_7O_{24}$, was dissolved in distilled water to give a saturated solution (room temperature, approx. 40% by weight) (solution C). A quantity of 1.99 mL of solution BB (approx. $3\times10^{-4}$ mol) was added with stirring to solution AA and 150 $\mu$L of solution C (approx. $4.2\times10^{-5}$ mol of salt, $2.94\times10^{-4}$ mol Mo) was added using a microsyringe. Finally, 0.3 mL of hydrochloric acid (36% by weight, $3\times10^{-3}$ mol) was added. The solution thus obtained was clear and colorless. An excess of $H_2S$ was bubbled through the resultant solution over a period of 5 hours, at the end of which, the solution had become opaque. Sixteen hours later (the next day) all volatile matter was removed under reduced pressure and the solid residue was dried under reduced pressure (0.1 mm Hg). Fifteen mL of freshly distilled tetrahydrofuran (THF) was added to the residue and the mixture was filtered through a porous glass filter (the precipitate left on the filter (CTAB) was brown). The resultant dark-brown solution was evaporated to dryness under reduced pressure (temperature less than 60° C.) and dried to give 0.2526 g of a dark-brown substance. Alkenyl succinimide (0.505 g) was added to the residue and the entire mixture was heated to 60° C. and thoroughly mixed manually using a glass rod. This product was tested in the Cameron-Plint machine after being formulated into an engine oil.

Cameron-Flint TE77 High Frequency Friction Machine Friction Coefficient

Testing

The anti-friction properties of the oil solubilized molybdenum nano-particles in a fully formulated lubricating oil were determined in the Cameron Plint TE77 Friction Test. The fully formulated lubricating oils tested contained 1.5 wt. % of the additive. The additives were tested for effectiveness in a motor oil at increasing temperature points and compared to are identical formulation without the friction modifier. In Table 3, the numerical value of the tee: results (Coefficient of Friction) decreases with an increase in effectiveness. In other words, the lower the Friction Coefficient value the better the additive is at reducing friction.

The test procedure for determining the friction coefficient with the Cameron-Plint TE77 High Frequency Friction Machine is as follows. Ten mL of an oil sample containing additive is placed in the test chamber so as to cover a flat stationary hardened ground NSOH B01 Gauge Plate (RC 60/0.4 micron). A reciprocating specimen, a 16 mm long nitrided steel dowel pin (6 mm diameter, 60 Rc), is placed on top of the steel plate under 50 Newton load, allowed to heat up to 35° C. from room temperature over 10 minutes and maintained at 35° C. for 5 minutes. Then, with the 50 Newton load in place, the reciprocation frequency of 5 Hertz is begun with a 15 millimeter amplitude stroke length. The temperature is then ramped up to 50° C. over 10 minutes and maintained at 50° C. for 5 minutes. The load is then increased to 100 Newtons and the temperature is ramped up to 165° C. over 1 hour. Friction Coefficient data are collected between 60–160° C. The flat specimen is cleaned between runs with hexanes and #500 emery cloth. A new dowel pin or surface of the dowel pin is used each time. A reference oil is run alternately between experimental oils: The same flat specimen is used until the reference oil no longer provides reproducible results.

The motor oil formulation tested is a SAE 10W-30 grade containing dispersant, detergent, antioxidant, rust inhibitor, pour point depressant, OCP VI Improver, and anti-wear additive. Friction modifier was added as a top treat to this formula.

TABLE 3

Cameron-Plint High Frequency Friction Machine Friction Results

| Additive | Wt. % (in oil) | Mo (ppm) (in oil) | C of F (μ) @ 60° C. | C of F (μ) @ 80° C. | C of F (μ) @ 100° C. | C of F (μ) @ 120° C. | C of F (μ) @ 140° C. | C of F (μ) @ 160° C. |
|---|---|---|---|---|---|---|---|---|
| Ex. 24 | 1.5 | 311 | 0.115 | 0.114 | 0.111 | 0.090 | 0.055 | 0.048 |
| Ex. 25 | 1.5 | 260 | 0.115 | 0.113 | 0.110 | 0.115 | 0.105 | 0.064 |
| No FM[1] | 0.0 | — | 0.125 | 0.127 | 0.130 | 0.133 | 0.130 | 0.125 |
| CFM[2] | 1.0 | — | 0.115 | 0.118 | 0.115 | 0.115 | 0.121 | 0.121 |
| MoDTC[3] | 0.53 | 309 | 0.110 | 0.113 | 0.100 | 0.085 | 0.065 | 0.525 |

[1]The reference oil is a fully formulated 10W-30 gasoline crank case motor oil containing no friction modifier.
[2]CFM is an ashless commercially available friction modifier based upon a mixture of fatty acid amides, glycerol esters, and glycerol.
[3]MoDTC is a commercially available molybdenum dithiocarbamate.
Additive from Example 24 contained 2.07 wt. % Mo, therefore the oil with the additive from Example 24 contained 311 ppm Mo.
Additive from Example 25 contained 1.73 wt. % Mo, therefore the oil with the additive from Example 25 contained 260 ppm Mo.
Additive MoDTC contained 5.83 wt. % Mo, therefore the oil with the additive MoDTC contained 309 ppm Mo.

In view of the many changes and modifications that can be made without departing from principles underlying the invention, reference should be made to the appended claims for an understanding of the scope of the protection to be afforded the invention.

What is claimed is:

1. A lubricant composition comprising:

A) a lubricant, and

B) at least one molybdenum-containing compound in the form of surface-capped nanosized particles of the general formula $$(Z)_n(X-R)_m$$

wherein:

Z is selected from the group consisting of $MoS_3$, $MoS_2O$, $Na_2MoS_4$, $Na_2MoS_3O$, $(NH_4)_2MoS_4$, $(NH_4)_2MoS_3O$, and hydrates thereof in the form of particles having dimensions in the range of from about 1 to about 100 nm;

(X–R) is a surface-capping reagent selected from the group consisting of alkyl amines, dialkyl amines, trialkyl amines, carboxylic acids, dicarboxylic acids, carboxylic acid amides, dicarboxylic acid diamides, alicyclic imides, ammonium or alkali metal dialkyldithiocarbamates, divalent metal bis-dialkyldithiocarbamates, trivalent metal tris-dialkyldithiocarbamates, tetraalkyl thiuram disulfides, and derivatives thereof;

n is the number of molecules of Z in the particles;

m is an integer representing the amount of surface-capping reagents relative to a single particle; and the ratio of m to n is in the range of from about 1:1 to about 10:1.

2. The lubricant composition of claim 1 wherein the alkyl amines, dialkyl amines, and trialkyl amines are of the formula $$R^1R^2R^3N$$

wherein: $R^1$, $R^2$, and $R^3$ are independently selected from the group consisting of hydrogen, straight or branched-chain $C_1$–$C_{20}$ alkyl, $C_6$–$C_{16}$ alkylaryl, and aryl.

3. The lubricant composition of claim 1 wherein the carboxylic and carboxylic acid amides are of the formula

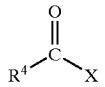

wherein X is OH, $NH_2$, $NHR^3$ or $NR^4R^4$ and $R^4$ is an straight or branched-chain, saturated or partially unsaturated, alkyl moiety of from 1 to 40 carbon atoms.

4. The lubricant composition of claim 1 wherein the alicyclic imides are of the formula

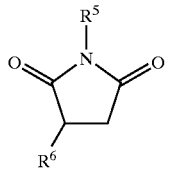

wherein $R^5$ is hydrogen, (C=O)$NHR^7$, or an alkylene amine wherein pairs of nitrogens are joined by alkylene groups, $R^6$ is hydrogen, straight or branched-chain ($C_2$–$C_{400}$)alkyl, and $R^7$ is H or ($C_1$–$C_{20}$ )alkyl.

5. The lubricant composition of claim 1 wherein the ammonium or alkali metal dialkyldithiocarbamates are of the formula

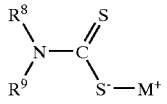

wherein $R^8$ and $R^9$ are independently selected from the group consisting of ($C_1$–$C_{24}$)alkyl and $M^+$ is $Na^+$, $K^+$, or $NH_4^+$.

6. The lubricant composition of claim 2 wherein the divalent metal bis-dialkyldithiocarbamate is a compound of the formula

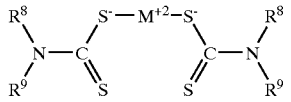

wherein $R^8$ and $r^9$ are selected from the group consisting of $(C_1-C_{24})$alkyl and $M^{+2}$ is $Fe^{+2}$, $Zn^{-2}$, $Pb^{+2}$, $Cu^{+2}$.

7. The lubricant composition of claim 1 wherein the trivalent metal tris-dialkyldithiocarbamates are of the formula

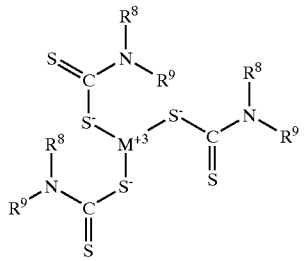

wherein $R^8$ and $R^9$ are selected from the group consisting of $(C_1-C_{24}$alkyl and $M^{+3}$ is $Sb^{+3}$ or $Bi^{+3}$.

8. The lubricant composition of claim 1 wherein the tetraalkyl thiuram disulfides are of the formula

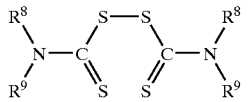

wherein $R^8$ and $R^9$ are independently selected from the group consisting of $(C_1-C_{24})$alkyl.

9. The lubricant composition of claim 1 wherein the molybdenum-containing compound in the form of surface-capped nanosized particles is employed in an amount of about 0.2 to about 5% by weight.

10. The lubricant composition of claim 9 further comprising at least one additional additive selected from the group consisting of dispersants, detergents, rust inhibitors, antioxidants, metal deactivators, anti-wear agents, antifoamants, friction modifiers, seal swell agents, demulsifiers, VI improvers, and pour point depressants.

11. A process for preparing, a molybdenum-containing compound in the form of surface-capped nanosized particles of the general formula $$(Z)_n(X-R)_m$$

wherein:

Z is selected from the group consisting of $MoS_3$, $Mos_2O$, $Na_2MoS_4$, $Na_2MoS_3O$, $(NH_4)_2MoS_4$, $(NH_4)_2Mos_3O$, and hydrates thereof in the form of particles having dimensions in the range of from about 1 to about 100 nm;

(X–R) is a surface-capping reagent selected from the group consisting of alkyl amines, dialkyl amines, trialkyl amines, carboxylic acids, dicarboxylic acids, carboxylic acid amides, dicarboxylic acid diamides, alicyclic imides, ammonium or alkali metal dialkyldithiocarbamates, divalent metal bis-dialkyldithiocarbamates, trivalent metal tris-dialkyldithiocarbamates, tetraalkyl thiuram disulfides, and derivatives thereof;

n is the number of molecules of Z in the particles;

to is an integer representing the amount of surface-capping reagents relative to a single particle; and the ratio of m to n is in the range of from about 1:1 to about 10:1;

wherein the process comprises the steps of:

A) creating a reversed microemulsion comprising a hydrocarbon-soluble surfactant solution in an organic solvent or solvent mixture and an aqueous solution of a water-soluble inorganic molybdenum (VI) compound;

B) if necessary to create a molybdenum/sulfur moiety, converting the water-soluble inorganic molybdenum (VI) compound into a thio-derivative by reaction with hydrogen sulfide;

C) adding a surfactant that chemically interacts with and/or adsorbs on the molybdenum/sulfur moiety;

D) removing water and the organic solvent(s) from the microemulsion and extracting the molybdenum/sulfur moiety-containing products thereof in the form of surface-capped nanosized particles with a suitable organic solvent; and E) removing said suitable organic solvent.

12. The process of claim 11 wherein the hydrocarbon-soluble surfactant is a cationic, anionic, or non-ionic surfactant.

13. The process of claim wherein 12 the hydrocarbon-soluble surfactant is cationic.

14. The process of claim 13 wherein the surfactant is tetraalkylammonium halide.

15. The process of claim 14 wherein the surfactant is cetyltrimethylammonium halide.

16. The process of claim 15 wherein the cetyltrimethylammonium halide is dissolved in chloroform:n-alkane (1:1 v/v) in a concentration of 0.01 to 0.1 mol/L.

17. The process of claim 16 wherein the n-alkane is selected from the group consisting of pentane, hexane, heptane, octane and isomers and mixtures thereof.

18. The process of claim 11 wherein the aqueous solution of water-soluble inorganic molybdenum (VI) compounds has pH less than or equal to 8.

19. The process of claim 11 wherein the surfactant that chemically interacts with and/or adsorbs on the molybdenum/sulfur moiety is added to the microemulsion in step A) or step B).

20. The process of claim 11 wherein the surfactant that chemically interacts with and/or adsorbs on the molybdenum/sulfur moiety is selected from the group consisting of alkyl amines, dialkyl amines, trialkyl amines, carboxylic acids, dicarboxylic acids, carboxylic acid amides, dicarboxylic acid diamides, alicyclic imides, ammonium or alkali metal dialkyldithiocarbamates, divalent metal bis-dialkyldithiocarbamates, trivalent metal tris-dialkyldithiocarbamates, tetraalkyl thiuram disulfides, and derivatives thereof.

21. The process of claim 20 wherein the alkyl amines, dialkyl amines, trialkyl amines are of the formula $$R^1R^2R^3N$$

wherein $R^1$, $R^2$, and $R^3$ are independently selected from the group consisting of hydrogen, straight or branched-chain $C_1-C_{28}$ alkyl, $C_6-C_{34}$ alkylaryl, and aryl.

22. The process of claim 20 wherein the carboxylic acids; and carboxylic acid amides are of the formula

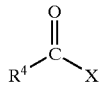

wherein X is OH, $NH_2$, $NHR^4$, or $NR^4R^4$ and $R^4$ is an straight or branched-chain, saturated or partially unsaturated, alkyl moiety of from 1 to 40 carbon atoms.

23. The process of clam 20 wherein the alicyclic imides are of the formula

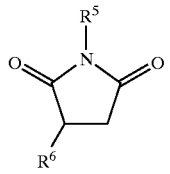

wherein $R^5$ is selected from the group consisting of hydrogen, (C═O)$NKR^7$, and alkylene amines wherein pairs of nitrogens are joined by alkylene groups; $R^6$ is selected from the group consisting of hydrogen and straight and branched-chain $(C_2–C_{400})$alkyl; and $R^7$ is hydrogen or $(C_1–C_{20})$ alkyl.

24. The process of claim 20 wherein the alkali metal dialkyldithiocarbamates are of the formula

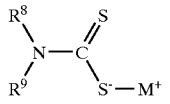

wherein $R^8$ and $R^9$ are independently selected from the group consisting of $(C_1–C_{24})$alkyl and $M^+$ is $Na^+$, $K^+$, or $NH_4^+$.

25. The process of claim 20 wherein the divalent metal bis-dialkyldithiocarbamates are of the formula

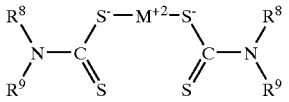

wherein $R^8$ and $R^8$ are independently selected from the group consisting of $(C_1–C_{24})$alkyl and $M^{+2}$ is $Fe^{+2}$, $Zn^{+2}$, $Pb^{+2}$, or $Cu^{-2}$.

26. The process of claim 20 wherein the trivalent metal tris-dialkyldithiocarbamates are of the formula

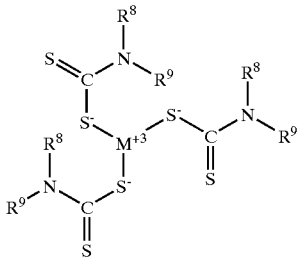

wherein $R^8$ and $R^9$ are selected from the group consisting of $(C_1–C_{24})$alkyl and $M^{+3}$ is $Sb^{+3}$ or $Bi^{+3}$.

27. The process of claim 20 wherein the thiuram disulfides are of the formula

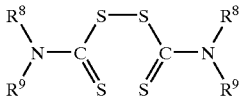

wherein $R^8$ and $R^9$ are independently selected from the group consisting of $(C_1–C_{24})$alkyl.

* * * * *